US011361609B2

(12) United States Patent
Zhou et al.

(10) Patent No.: US 11,361,609 B2
(45) Date of Patent: Jun. 14, 2022

(54) VENDING MACHINE AND ITEM CHANNEL DELIVERY METHOD

(71) Applicants: Shandong New Beiyang Information Technology Co., Ltd., Shandong (CN); Weihai New Beiyang Digital Technology Co., Ltd., Shandong (CN)

(72) Inventors: Chong Zhou, Shandong (CN); Jiabo Xu, Shandong (CN); Tengfei Zhang, Shandong (CN); Xinping Wang, Shandong (CN); Qiangzi Cong, Shandong (CN); Tianxin Jiang, Shandong (CN); Chuntao Wang, Shandong (CN)

(73) Assignee: SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 3 days.

(21) Appl. No.: 17/264,053

(22) PCT Filed: Jul. 31, 2019

(86) PCT No.: PCT/CN2019/098513
§ 371 (c)(1),
(2) Date: Jan. 28, 2021

(87) PCT Pub. No.: WO2020/024963
PCT Pub. Date: Feb. 6, 2020

(65) Prior Publication Data

US 2021/0375086 A1 Dec. 2, 2021

(30) Foreign Application Priority Data

Aug. 1, 2018 (CN) ..... 201810865957.0

(51) Int. Cl.
*G07F 11/24* (2006.01)
*G07F 11/16* (2006.01)
*G07F 11/00* (2006.01)

(52) U.S. Cl.
CPC ..... *G07F 11/24* (2013.01); *G07F 11/007* (2013.01); *G07F 11/16* (2013.01); *G07F 11/163* (2020.05); *G07F 11/1653* (2020.05)

(58) Field of Classification Search
None
See application file for complete search history.

(56) References Cited

U.S. PATENT DOCUMENTS

2006/0208851 A1* 9/2006 Tsunoda ..... G07F 11/58 340/572.1
2006/0261080 A1 11/2006 Matsumoto et al.
2007/0021866 A1* 1/2007 Coppola ..... G07F 11/04 700/231

FOREIGN PATENT DOCUMENTS

CN 102289881 A 12/2011
CN 202205267 U 4/2012
(Continued)

OTHER PUBLICATIONS

International Search Report issued in related International Application Serial No. PCT/CN2019/098513 dated Oct. 29, 2019, 4 pages.
(Continued)

*Primary Examiner* — Gene O Crawford
*Assistant Examiner* — Ayodeji T Ojofeitimi
(74) *Attorney, Agent, or Firm* — Mark H. Whittenberger; Holland & Knight LLP

(57) ABSTRACT

Disclosed are a vending machine and an item dispensing method of storage column thereof. In the item dispensing method of the storage column of the vending machine, controlling the first motor to start rotating for the first time to convey the target item to the inlet of the bucket; when
(Continued)

detecting that the target item reaches the inlet of the bucket, controlling the first motor to stop rotating for the first time to make the target item enter the inside of the bucket under the driving of the second motor.

14 Claims, 5 Drawing Sheets

(56) References Cited

FOREIGN PATENT DOCUMENTS

| | | | |
|---|---|---|---|
| CN | 102637322 | A | 8/2012 |
| CN | 202512664 | U | 10/2012 |
| CN | 103098103 | A | 5/2013 |
| CN | 103119633 | A | 5/2013 |
| CN | 103280024 | A | 9/2013 |
| CN | 204256833 | U | 4/2015 |
| CN | 204303081 | U | 4/2015 |
| CN | 106297008 | A | 1/2017 |
| CN | 106327691 | A | 1/2017 |
| CN | 108154603 | A | 6/2018 |
| JP | 2009059289 | A | 3/2009 |
| WO | 2004108583 | A2 | 12/2004 |

OTHER PUBLICATIONS

First Office Action issued in related Chinese Application No. 201810865957.0 dated Jul. 20, 2020.
Second Office Action issued in related Chinese Application No. 201810865957.0 dated Dec. 7, 2020.

* cited by examiner

VENDING MACHINE AND ITEM CHANNEL DELIVERY METHOD

RELATED APPLICATIONS

The subject application is a U.S. National Stage application of International Application No. PCT/CN2019/098513, filed on 31 Jul. 2019, which claims the priority of Chinese Patent Application No. 201810865957.0, filed on 1 Aug. 2018, the contents of which are herein incorporated by reference in their entirety.

TECHNICAL FIELD

This application relates to the technical field of automatic vending, such as a vending machine and an item dispensing method of storage column.

BACKGROUND

The vending machine is a commercial automation device used for automatic sales of items. Vending machines are more and more widely used due to the advantages of no time and place restrictions, manpower reduction and easy transactions.

A vending machine is disclosed in the related art. The vending machine includes a cabinet body, a pickup port arranged on the surface of the cabinet body, and a storage column and a bucket arranged inside the cabinet body. The storage column is configured to accommodate items; the bucket is arranged between the storage column and the pickup port, and is configured to deliver items between the storage column and the pickup port; the storage column is provided with an outlet, and is provided with a push plate for pushing the items to move; the bucket has a receiving inlet, and is provided with a detecting mechanism. During dispensing an item from a target storage column which is configured to accommodate items, the bucket is moved to the target storage column first to make the receiving inlet of the bucket opposite to the outlet of the target storage column, then the push plate in the target storage column is controlled to push the items to move, so that the item at the forefront of the target storage column is conveyed out from the outlet of the target storage column and enter the inside of the bucket through the receiving inlet of the bucket; after the detecting mechanism detects that the item enter the inside of the bucket, the push plate is controlled to stop pushing the item to move, so as to complete the item dispensing from the target storage column.

However, the vending machine in the related art is prone to abnormal operation of the equipment due to the abnormal delivery of items by the bucket after the item dispensing from the target storage column.

SUMMARY

The following is a summary of the subject detailed in this paper. This summary is not intended to limit the scope of the claims.

This application provides an item dispensing method of a storage column of a vending machine, so as to avoid the situation that the vending machine in the related technology is prone to abnormal operation of the equipment after the item dispensing from the target storage column. This application also provides a vending machine to realize the item dispensing method.

The embodiment of this application provides a vending machine, including a control device, a cabinet, a pickup port arranged on the cabinet, a storage column and a bucket arranged inside the cabinet, where the storage column is configured to accommodate items; the bucket is arranged between the storage column and the pickup port, and is configured to deliver items between the storage column and the pickup port; the storage column is provided with an outlet, and the bucket is provided with an inlet. The vending machine further includes a first motor for driving the items in the storage column to move toward the outlet of the storage column, a second motor for driving the items at the inlet of the bucket to enter the inside of the bucket, and a detecting device for detecting whether there are items located at the inlet of the bucket. The detecting device, the first motor and the second motor are respectively electrically connected with the control device, and the control device is configured to control the first motor to start rotating for the first time to convey a target item to the inlet of the bucket; when detecting that the target item reaches the inlet of the bucket, control the first motor to stop rotating for the first time to make the target item enter the inside of the bucket under the driving of the second motor, where the target item is at least one item closest to the bucket in the storage column.

The embodiment of this application provides an item dispensing method of a storage column of a vending machine, where the vending machine includes a cabinet, a pickup port arranged on the cabinet, a storage column and a bucket arranged inside the cabinet. The storage column is configured to accommodate items; the bucket is arranged between the storage column and the pickup port, and is configured to deliver items between the storage column and the pickup port; the storage column is provided with an outlet, and the bucket is provided with an inlet. The vending machine further includes a first motor for driving the items in the storage column to move toward the outlet of the storage column, a second motor for driving the items at the inlet of the bucket to enter the inside of the bucket, and a detecting device for detecting whether there are items located at the inlet of the bucket. The item dispensing method of the storage column comprises: controlling the first motor to start rotating for the first time to convey an item to the inlet of the bucket; when detecting that the target item reaches the inlet of the bucket, controlling the first motor to stop rotating for the first time to make the target item enter the inside of the bucket under the driving of the second motor.

Other aspects will become apparent after the drawings and the detailed description are read and understood.

BRIEF DESCRIPTION OF DRAWINGS

Brief introduction is provided in the following for the drawings necessary in embodiment description to give a clearer description of the technical scheme in the embodiments of this application. It should be understood that drawings below illustrate only some embodiments of this application, and, therefore, should not be construed as a limitation of scope, and other related drawings can be acquired based on the said drawings by general technicians in the field without making any creative effort.

Figure 1:
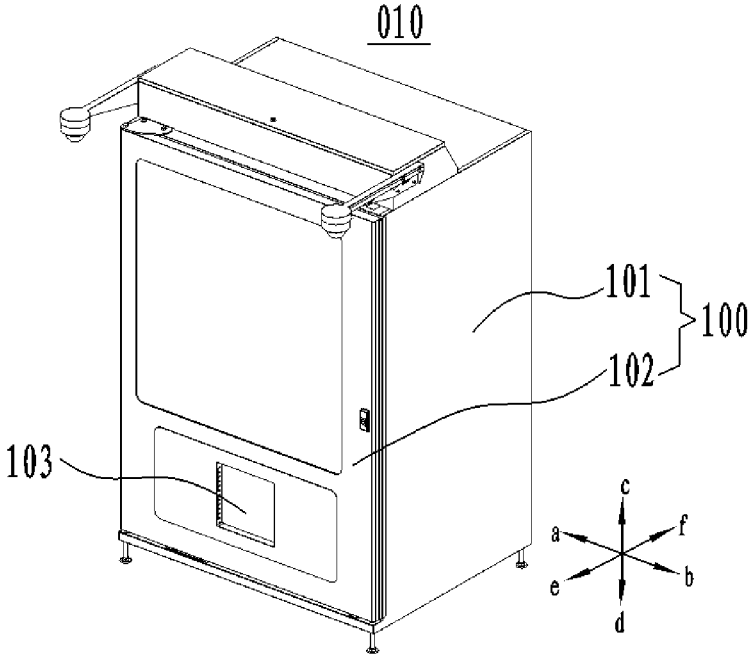
FIG. 1 is a schematic structural diagram of the external structure of a vending machine according to an embodiment of this application.

In the drawings: 010—vending machine; 100—cabinet; 101—cabinet body; 102—cabinet door; 103—pickup port; 200—storage device; 210—storage column; 211—first conveying mechanism; 211*a*—push plate; 211*b*—first motor; 300—delivery device; 310—bucket; 311—second conveying mechanism; 311*a*—second motor; 311*b*—triangular roller; 311*c*—transitional roller; 320—bucket driving mechanism; 321—horizontal driving mechanism; 322—vertical driving mechanism; 400—detecting device; 410—photoelectric sensor; 500—control device.

DETAILED DESCRIPTION

The solutions in the embodiments of this application will be clearly and completely described as follows by combining with the drawings herein. Obviously, the described embodiments are only some of rather than all of the embodiments of this application. The components of the embodiments of the application, which are described and illustrated in the drawings herein, generally may be arranged and designed in various different configurations.

Therefore, the following detailed descriptions of embodiments of this application in the drawings are not intended to limit the scope of this application, but merely represent selected embodiments of this application. Based on the embodiments described herein, other embodiments acquired by general technicians in the field without making any creative effort also belong to the protection scope of the application.

It is to be noted that similar numbers and letters refer to similar items in the following drawings. Therefore, once an item is defined in one drawing, the item will not be further defined or explained in the subsequent drawings.

It is to be noted that in the descriptions of embodiments of the application that the terms "central", "upper", "lower", "left", "right", "vertical", "horizontal", "inside" and "outside" and the like indicate an orientation or positional relationship based on those shown in the drawings or on how the application product is normally placed, and are used only for facilitating the description of the application and for simplified description, not for indicating or implying that the target devices or components must have a special direction and be structured and operated at the special direction, thereby they cannot be understood as the restrictions to the application. Moreover, the words "first" and "second" are only used for distinguishing descriptions, and cannot be understood as indicating or implying relative importance.

The applicant finds that during the item dispensing from a target storage column of a vending machine in the related art, after an item enter a bucket, a next item in the target storage column, that is, the item at the forefront in the target storage column may extend from an outlet of the target storage column to the outside of the target storage column, and the item extending to the outside of the target storage column is easy to block the movement of the bucket, thus causing abnormal delivery of item by the bucket. Therefore, the vending machine in the related technology has the situation that the item at the forefront of the target storage column extends out from the outlet of the target storage column after the item dispensing from the target storage column, causing abnormal delivery of item by the bucket, which leads to the abnormal operation of the equipment.

Figure 2:
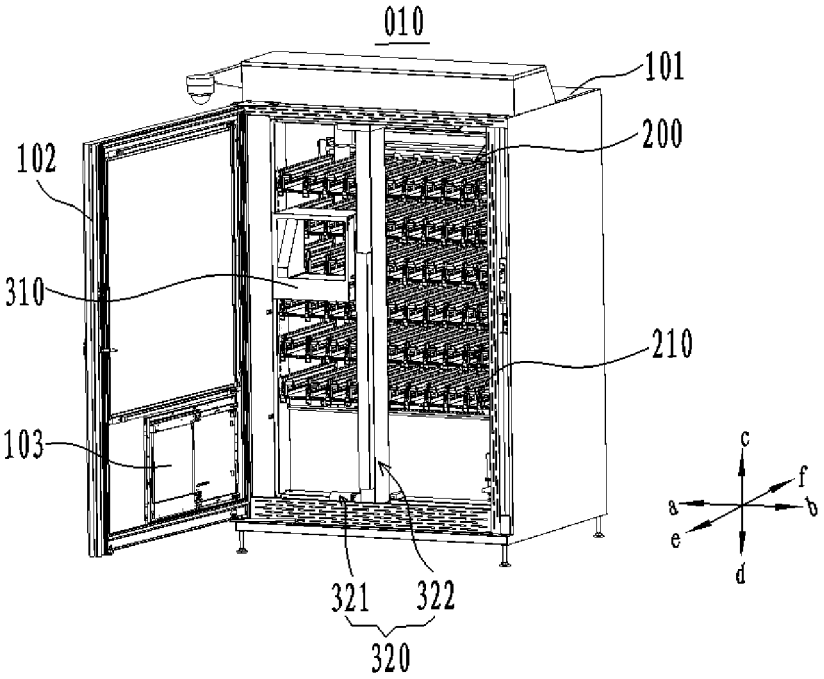
FIG. 2 is a schematic structural diagram of the internal structure of a vending machine according to an embodiment of the application.
Figure 3:
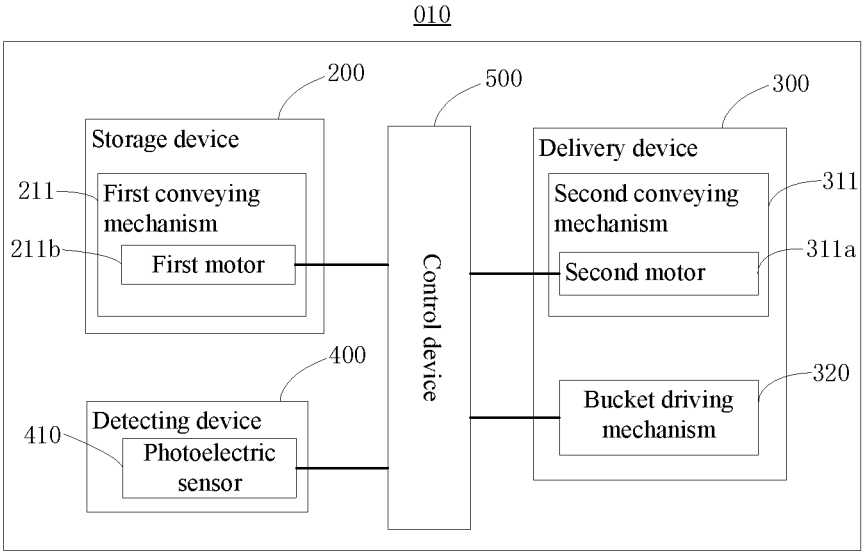
FIG. 3 is a block diagram of a vending machine according to an embodiment of the application.

FIG. 1 is a schematic structural diagram of the external structure of a vending machine according to an embodiment of this application, FIG. 2 is a schematic structural diagram of the internal structure of a vending machine according to an embodiment of the application, and FIG. 3 is a block diagram of a vending machine according to an embodiment of the application. The vending machine according to an embodiment of this application will be described below with reference to FIGS. 1 to 3.

As shown in FIGS. 1 to 3, the vending machine 010 includes a cabinet 100, a storage device 200, a delivery device 300, a detecting device 400 and a control device 500.

As shown in FIG. 1, the cabinet 100 includes a cabinet body 101 and a cabinet door 102, where the cabinet body 101 is in a flexible connection with the cabinet door 102; the cabinet body 101 includes an opening (not shown), and the cabinet door 102 is movable relative to the opening of the cabinet body 101 to open or close the cabinet body 101. A pickup port 103 is arranged on the cabinet door 102 for users to take out the items.

The storage device 200 is configured to accommodate items. As shown in FIG. 2, the storage device 200 is arranged in the cabinet body 101 and relatively spaced from the cabinet door 102. The storage device 200 includes a plurality of storage columns 210 for accommodating items. The storage columns 210 are arranged in M layers along the up-down direction (i.e. the direction indicated by an arrow cd) and N rows along the left-right direction (i.e. the direction indicated by an arrow ab), and the length of the storage columns 210 extends along the front-back direction (i.e. the direction indicated by an arrow ef). One end of the storage column 210 close to the cabinet door 102 is provided with an outlet which is facing the cabinet door 102.

Figure 4:
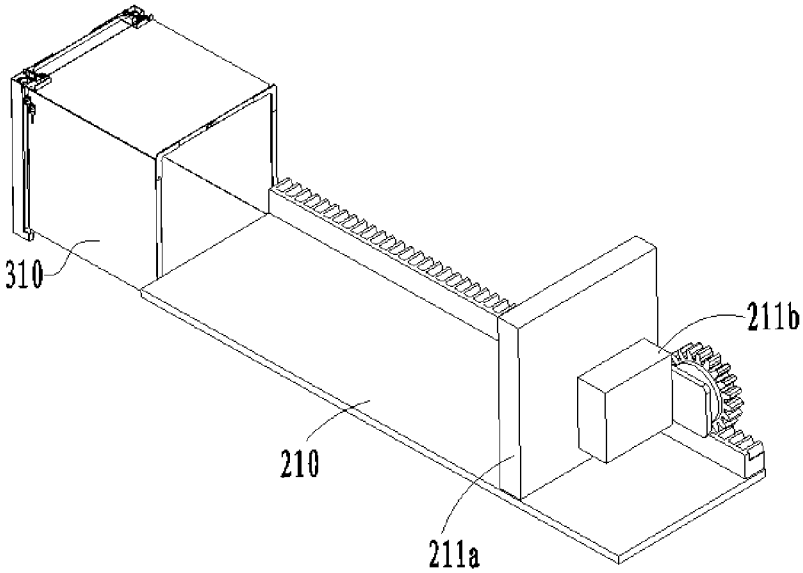
FIG. 4 is a schematic structural diagram of the local structure of a vending machine according to an embodiment of the application.

The storage column 210 includes a first conveying mechanism 211, which is configured to drive the items in the storage column 210 to move to the outlet of the storage column 210, so as to convey the items out from the outlet of the storage column 210 to the outside of the storage column 210. FIG. 4 is a schematic structural diagram of the local structure of a vending machine according to an embodiment of this application. As shown in FIG. 4, in this embodiment, the first conveying mechanism 211 includes a push plate 211*a* and a first motor 211*b*, the first motor 211*b* is electrically connected with the control device 500 and is in transmission connection with the push plate 211*a*. Under the control of the control device 500, the first motor 211*b* is capable of driving the push plate 211*a* to move along the length direction of the storage column 210, so as to push the item in the storage column 210 to move toward the outlet of the storage column 210.

The delivery device 300 is configured to deliver items between the storage device 200 and the pickup port 103. The delivery device 300 is located between the cabinet door 102 and the storage device 200. The delivery device 300 includes a bucket 310 and a bucket driving mechanism 320. One end of the bucket 310 close to the cabinet door 102 is provided with an outlet, and one end of the bucket 310 close to the storage column 210 is provided with an inlet. The bucket driving mechanism 320 includes a horizontal driving mechanism 321 and a vertical driving mechanism 322, which are electrically connected with a control device 500 respectively. Under the control of the control device 500, the horizontal driving mechanism 321 drives the bucket 310 to move along the left-right direction, and the vertical driving mechanism 322 drives the bucket 310 to move along the up-down direction, so as to the bucket 310 is capable of moving in the horizontal direction, or moving in the vertical direction, or moving in the horizontal direction and the vertical direction simultaneously, so that the inlet of the bucket 310 is opposite to the outlet of any one of the storage columns 210, or the outlet of the bucket 310 is opposite to the pickup port 103. In the case that the inlet of the bucket 310 is opposite to the outlet of any one of the storage columns 210, the item in the storage column 210 can be delivered to the bucket 310 through the inlet of the bucket 310 after being conveyed out from the outlet of the storage column 210; in the case that the outlet of the bucket 310 is opposite to the pickup port 103, a user can take away the item in the bucket 310 through the pickup port 103.

Figure 5:
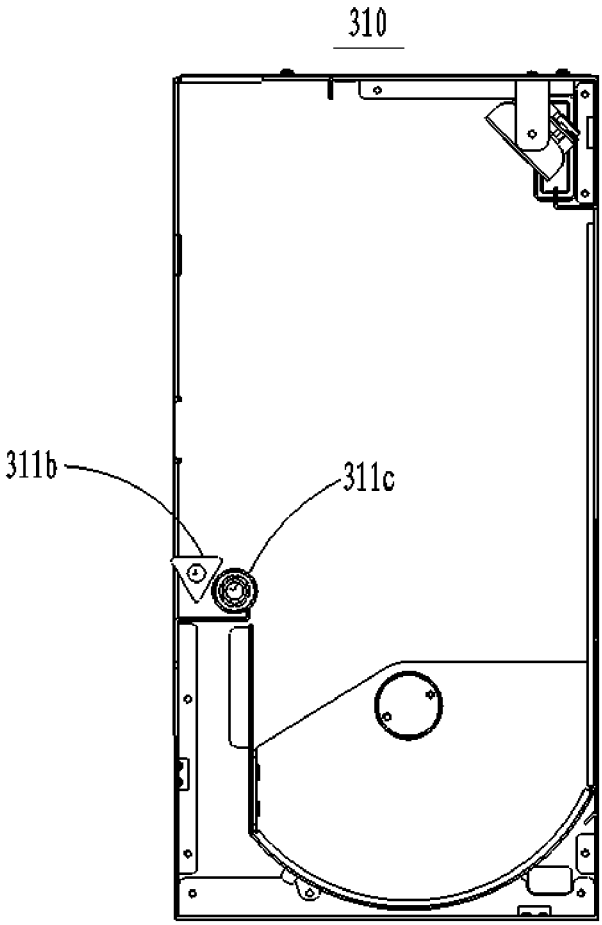
FIG. 5 is a schematic structural diagram of a bucket of a vending machine according to an embodiment of this application.

The inlet of the bucket 310 is provided with a second conveying mechanism 311, which is configured to drive the item at the inlet of the bucket 310 to enter the inside of the bucket 310. In this embodiment, the second conveying mechanism 311 includes a kicking assembly and a second motor 311*a*. The kicking assembly is arranged at one side of the inlet of the bucket 310 for receiving the item conveyed out from the outlet of the storage column 210. The second motor 311*a* is electrically connected with the control device 500 and is in transmission connection with the kicking assembly. Under the control of the control device 500, the second motor 311*a* is capable of driving the roller of the kicking assembly to rotate along its own axis, so as to drive the item to move from the inlet of the bucket 310 to the inside of the bucket 310, thus making the item enter the inside of the bucket 310. FIG. 5 is a schematic structural diagram of a bucket of the vending machine according to an embodiment of this application. As shown in FIG. 5, in this embodiment, the kicking assembly includes a triangular roller 311*b* and a transitional roller 311*c* which are arranged at intervals along the front-back direction. Both the triangular roller 311*b* and the transitional roller 311*c* are in transmission connection with the second motor 311*a*. Under the action of the second motor 311*a*, the triangular roller 311*b* and the transitional roller 311*c* rotate simultaneously, so as to rapidly convey the item into the bucket 310 to improve the efficiency of item transportation.

The detecting device 400 is configured to detect whether the item reaches the inlet of the bucket 310 and whether the item enters the inside of the bucket 310. The detecting device 400 outputs a first signal when detecting that there is an item at the inlet of the bucket 310, and outputs a second signal when detecting that there is no item at the inlet of the bucket 310. The control device 500 is configured to determine that an item reaches the inlet of the bucket 310 when receiving the first signal, and determine that no item reaches the inlet of the bucket 310 when receiving the second signal. In an embodiment, the detecting device 400 is arranged at the inlet of the bucket 310, and is configured to detect whether there is an item at the inlet of the bucket 310. In this embodiment, the detecting device 400 includes at least one photoelectric sensor 410. A light generator and a light receiver of the photoelectric sensor 410 are oppositely arranged on both sides of the inlet of the bucket 310. When there is an item at the inlet of the bucket 310, a light path between the light generator and the light receiver of the photoelectric sensor 410 is cut off, and the photoelectric sensor 410 outputs a first signal; when there is no item at the inlet of the bucket 310, the light receiver of the photoelectric sensor 410 receives the light emitted by the light generator, and the photoelectric sensor 410 outputs a second signal. In an embodiment, the detecting device 400 includes a plurality of photoelectric sensors 410, and the light generator and the light receiver of each photoelectric sensor 410 are oppositely arranged on both sides of the inlet of the bucket 310. When there is an item at the inlet of the bucket 310, at least one photoelectric sensor 410 outputs a first signal, and when there is no item at the inlet of the bucket 310, all photoelectric sensors 410 output a second signal. The photoelectric sensor 410 is electrically connected with the control device 500, and the control device 500 is capable of determining whether there is an item at the inlet of the bucket 310 according to the signal output by the photoelectric sensor 410, and then determining whether the item reaches the inlet of the bucket 310 and whether the item enters the inside of the bucket 310. In the case that any photoelectric sensor 410 of the detecting device 400 outputs the first signal, the control device 500 determines that there is an item at the inlet of the bucket 310; in the case that all photoelectric sensors 410 of the detecting device 400 output the second signal, the control device 500 determines that there is no item at the inlet of the bucket 310. In the case that the control device 500 determines that the inlet of the bucket 310 is changed from no item to having an item, it is determined that the item reaches the inlet of the bucket 310; in the case that the control device 500 determines that the inlet of the bucket 310 is changed from having an item to no item, it is determined that the item enters the inside of the bucket 310.

The control device 500 is electrically connected with the detecting device 400, the first motor 211*b* and the second motor 311*a* respectively. The control device 500 is configured to control the operation of the above modules. For example, the control device 500 is configured to control the bucket driving mechanism 320 to drive the bucket 310 to move to the position of a storage column 210 containing an item (hereinafter referred to as the "target storage column"), control the first conveying mechanism 211 of the target storage column to convey the item to the inlet of the bucket 310 and control the second conveying mechanism 311 of the bucket 310 to convey the item to the inside of the bucket 310, determine whether the item reaches the inlet of the bucket 310 according to the received signal from the detecting device 400, and control the first conveying mechanism 211 to stop conveying the item based on the determination result that the item reaches the inlet of the bucket 310, so as to make the item enter the inside of the bucket 310 under the driving of the second conveying mechanism 311.

In an embodiment, the control device 500 is configured to control the first motor 211*b* to start rotating for the first time to convey a target item to the inlet of the bucket 310, when detecting that the target item reaches the inlet of the bucket 310, control the first motor 211*b* to stop rotating for the first time to make the target item enter the inside of the bucket 310 under the driving of the second motor 311*a*, where the target item is at least one item closest to the bucket 310 in the storage column 211.

In the vending machine provided by this embodiment, when detecting that the item reaches the inlet of the bucket, the control device controls the first motor of the target storage column to stop conveying the item to the outlet of the target storage column to make the item enter the inside of the bucket under the driving of the second motor. Due to that other items will not extend out of the outlet of the target storage column during the process of the item entering the bucket because of the continuous conveying, it is able to avoid abnormal operation conditions in related technologies arising from a situation that an item at the forefront of the target storage column extends out of the outlet of the target storage column after item dispensing from same.

In order to convey the target item into the bucket 310 immediately when it reaches the inlet of the bucket 310, in an embodiment, when a first motor 211*b* is controlled to start rotating for the first time, a second motor 311*a* is controlled to start rotating to make the target item enter the inside of the bucket immediately under the driving of the second motor 311*a* after reaching the inlet of the bucket 310. It should be understood that in some embodiments of this application, a second motor 311*a* may also start rotating at any time before the target item reaches the inlet of the bucket 310, or within a period after the target item reaches the inlet of the bucket 310.

Further, the control device 500 is further configured to determine whether the target item enters the inside of the bucket 310 within a first preset time from the moment when the first motor 211*b* stops rotating for the first time, based on the determination result that the target item does not enters the inside of the bucket 310 within a first preset time, the first motor 211*b* is controlled to rotate at least one more time, where the first motor 211*b* rotating one time refers to the process that the first motor 211*b* starts to rotate, and stops rotating after continuously rotating for a second preset time. In this way, within a first preset time after the first motor 211*b* conveys the target item for the first time, if the target item does not enter the inside of the bucket 310, at least one more conveying can be carried out to ensure that the target item can be conveyed into the bucket 310 by the second motor 311*a* as far as possible.

The control device 500 is configured to control the first motor 211*b* to rotate at least one more time by the following method: after the control device 500 controls the first motor 211*b* to rotate at least one more time (i.e., excluding the first rotation), it determines whether the target item enters the inside of the bucket 310 within a third preset time from the moment when the first motor 211*b* stops rotating each time; based on the determination result that the target item does not enter the inside of the bucket 310 within the third preset time from the moment when the first motor 211*b* stops rotating this time, the first motor 211*b* is controlled to rotate for the next time. In this way, the first motor 211*b* is capable of repeatedly conveying the target item several times until the target item enters the inside of the bucket 310 under the driving of the second motor 311*a*.

In one or more embodiments, the control device 500 is configured to control the first motor 211*b* to rotate at least one more time by the following method: after the control device 500 controls the first motor 211*b* to rotate at least one more time (i.e., excluding the first rotation), it determines whether the target item enters the inside of the bucket 310 within a third preset time from the moment when the first motor 211*b* stops rotating each time; based on the determination result that the target item does not enter the inside of the bucket 310 within the third preset time from the moment when the first motor 211*b* stops rotating this time, it determines whether a number of rotations since the first motor 211*b* starts rotating for the first time to convey the target item to the inlet of the bucket 310 reaches a preset number; based on the determination result that the number of rotations of the first motor 211*b* does not reach the preset number, the first motor 211*b* is controlled to rotate for the next time. Based on the determination result that the number of rotations of the first motor 211*b* reaches the preset number, alarm information of abnormal dispensing of item from the storage column 210 is output.

In such a control mode, it can be determined that the item dispensing from the storage column 210 is abnormal after the number of rotations of the first motor 211*b* reaches the preset number, thus avoiding the risk of equipment damage caused by the continuous repeated rotation of the first motor 211*b* because the target item cannot enter the inside of the bucket 310. The staff can also be reminded timely to maintain the equipment by the output alarm information of abnormal dispensing of item from the storage column.

In addition, the control device 500 is further configured to control the bucket 310 to move to the storage column 210 before controlling the first motor 211*b* to start rotating for the first time to convey the target item to the inlet of the bucket 310, so as to make the inlet of the bucket 310 opposite to the outlet of the storage column 210. The storage column 210 mentioned here is a storage column in which items to be purchased by users are displayed. The control device 500 is further configured to control the second motor 311*a* to stop rotating when the target item enters the inside of the bucket 310.

Figure 6:
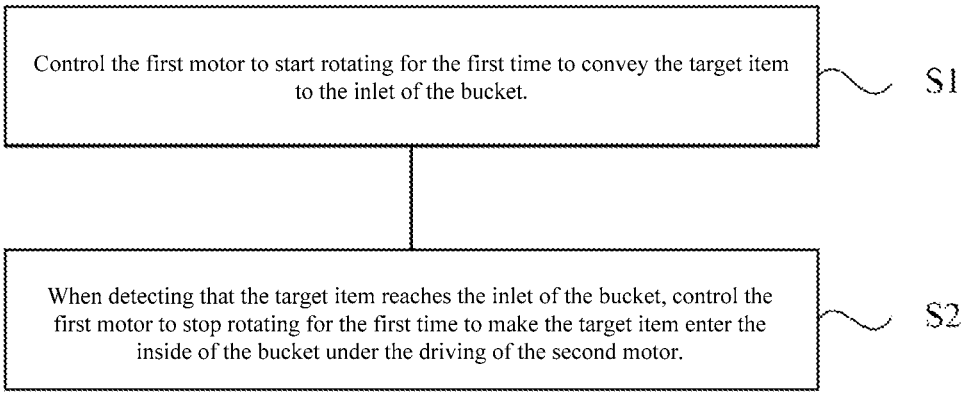
FIG. 6 is a flow chart of an item dispensing method of a storage column of a vending machine according to an embodiment of this application.

FIG. 6 is a flow chart of an item dispensing method of storage column of the vending machine according to an embodiment of this application. As shown in FIG. 6, the item dispensing method of storage column includes steps S1 and S2.

In step S1, control the first motor to start rotating for the first time to convey the target item to the inlet of the bucket.

Taking the vending machine 010 provided in this application as an example, the control device 500 determines the storage column (hereinafter referred to as the target storage column) accommodating item to be purchased according to the user's purchase instruction, and then controls the bucket driving mechanism 320 to drive the bucket 310 to move to the position corresponding to a target storage column 210, so that the inlet of the bucket 310 is opposite to the outlet of the target storage column. Then the control device 500 controls the first motor 211*b* to start rotating for the first time to drive the items in the target storage column to move towards the outlet of the target storage column, i.e., move towards the inlet of bucket 310, and controls the second motor 311*a* of the bucket 310 to convey the item to the inside of the bucket 310. In an embodiment, the control device 500 controls the first motor 211*b* to start rotating for the first time to convey the item to the inlet direction of the bucket 310, and at the same time controls the second motor 311*a* to start rotating to drive and convey the item to the inside of the bucket 310. It should be understood that, when the method is applied to a vending machine with only one storage column, the process of determining the target storage column can be saved, and the bucket is moved directly to the position corresponding to the storage column. And the second motor 311*a* may start rotating before the target item reaches the inlet of the bucket 310 or start rotating when the target item reaches the inlet of the bucket 310. It should be understood that, the first motor 211*b* "starting rotating for the first time" in the embodiment of this application refers to the first motor 211*b* rotating for the first time in the dispensing process for the target item.

In Step S2, when detecting that the target item reaches the inlet of the bucket, control the first motor to stop rotating for the first time to make the target item enter the inside of the bucket under the driving of the second motor.

Taking the vending machine 010 provided in this application as an example, the detecting device 400 sends the first signal when detecting that there is an item in the inlet of the bucket 310, and sends the second signal when detecting that there is no item in the inlet of the bucket 310. After the control device 500 controls the first motor 211*b* of the target storage column to rotate, the target item, under the driving by the first motor 211*b* of the target storage column, reaches the outlet of the target storage column and gradually extends out of the outlet of the target storage column to enter the inlet of the bucket 310. When receiving the first signal output by the detecting device 400, the control device 500 determines that the item reaches the inlet of the bucket 310 and controls the first motor 211*b* to stop rotating for the first time, so that the first motor 211*b* stops conveying the item. In an embodiment, based on the signal output by the photoelectric sensor 410 of the detecting device 400, the control device 500 determines whether the item reaches the inlet of the bucket 310, when determining the inlet of the bucket 310 changed from no item to having an item, the control device determines that the item reaches the inlet of the bucket 310. The control device 500 controls the first motor 211*b* of the target storage column to stop conveying the item, so as to make the item enter the inside of the bucket 310 under the driving by the second motor 311*a*. It should be understood that, the first motor 211*b* "stopping rotating for the first time" in the embodiment of this application refers to stopping rotating for the first time in the dispensing process for the target item.

In an embodiment, when determining that the item reaches the inlet of the bucket 310, the control device 500 controls the first motor 211*b* to stop rotating, i.e., controls the first motor 211*b* to stop conveying the item to enable the item to enter the inside of the bucket 310 only under the driving by the second motor 311*a* of the bucket 310. This makes other items not to extend out of the outlet of the target storage column during the item enters the bucket 310 due to the continuous delivery of the first motor 211*b*, so as to avoid abnormal operation conditions of the vending machine in related technologies arising from the situation that the item at the forefront of the target storage column extends out of the outlet of the target storage column after item dispensing from same.

In the item dispensing method of the storage column of the vending machine provided by this embodiment, when detecting that the target item reaches the inlet of the bucket, the control device controls the first motor of the target storage column to stop conveying the item to the outlet of the storage column, to make the item enter the inside of the bucket under the driving of the second motor. Due to that other items do not extend out of the outlet of the target storage column during the item enters the bucket because of the continuous conveying, it is able to avoid abnormal operation conditions in related technologies arising from a situation that an item at the forefront of the target storage column extends out of the outlet of the target storage column after item dispensing from same.

Figure 7:
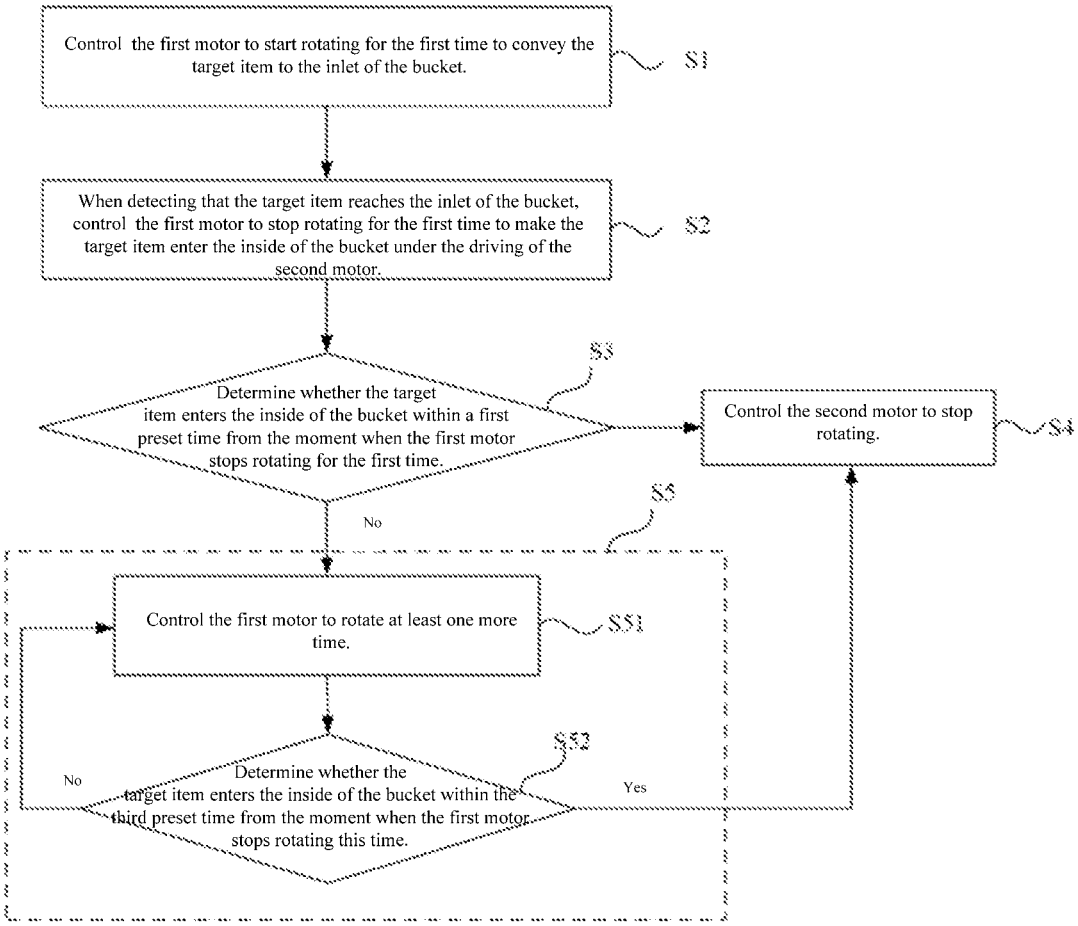
FIG. 7 is a flow chart of a second item dispensing method of a storage column of a vending machine according to an embodiment of this application.

FIG. 7 is a flow chart of a second item dispensing method of a storage column of a vending machine according to an embodiment of this application. This embodiment can be an example of the embodiment shown in FIG. 6. As shown in FIG. 7, this embodiment differs from the embodiment shown in FIG. 6 in that the item dispensing method further includes Steps S3-S5.

In Step S3, determine whether the target item enters the inside of the bucket within a first preset time from the moment when the first motor stops rotating for the first time.

Taking the vending machine 010 provided in this application as an example, the control device 500 determines whether the target item enters the inside of the bucket 310 within a first preset time from the moment when the first motor 211*b* stops rotating for the first time. In an embodiment, based on the signal output by the detecting device 400, the control device 500 detects whether the inlet of the bucket 310 changes from having an item to no item, and when detecting that the inlet of the bucket 310 changes from having an item to no item, the control device 500 determines that the target item enters the inside of the bucket 310. It should be understood that, in the case where the target item includes a plurality of items, the detecting device 400 can include an image sensor. When the image sensor detects that all items of the target item enter the inside of the bucket 310, the control device 500 determines the target item enter the inside of the bucket 310. When determining that the target item enters the inside of the bucket 310 within a first preset time, the control device 500 performs Step S4. When determining that the target item does not enter the inside of the bucket 310 within the first preset time, the control device 500 performs Step S5.

In Step S4, control the second motor to stop rotating.

Taking the vending machine 010 provided in this application as an example, when determining that the target item enters the inside of the bucket 310 within the first preset time, the control device 500 controls the second motor 311*a* to stop rotating, so that the second motor 311*a* stops conveying the item to the inside of the bucket 310.

In Step S5, control the first motor to rotate at least one more time.

Taking the vending machine 010 provided in this application as an example, when determining the target item does not enter the inside of the bucket 310 within the first preset time, the control device 500 controls the first motor 211*b* to rotate at least one more time, where the first motor 211*b* rotating one time refers to the process that the first motor 211*b* starts to rotate, and stops rotating after continuously rotating for a second preset time. In this embodiment, the control device 500 controls the first motor 211*b* to convey the item in the target storage column, and controls the first motor 211*b* to stop conveying the item when the conveying time of the first motor 211*b* reaches the second preset time.

In the item dispensing method of the storage column of the vending machine provided by this embodiment, the control device determines whether the target item enters the inside of the bucket within a first preset time from the moment when the first motor stops rotating for the first time. If the target item does not enter the inside of the bucket within the first preset time, the control device controls the first motor to convey the item at least once for a second preset time, so as to convey the target item to the inside of the bucket and ensure the reliability of the item dispensing of the storage column.

In an embodiment, in Step S5, the control device controls the first motor to rotate at least one more time in the following manner: the control device determines whether the target item enters the inside of the bucket within a third preset time from the moment when the first motor stops rotating each time, and controls the first motor to rotate for the next time based on the determination result that the target item does not enter the inside of the bucket within the third preset time from the moment when the first motor stops rotating this time. That is, Step S5 includes Step S51 and Step S52.

In Step S51, control the first motor to rotate one more time.

Taking the vending machine 010 provided in this embodiment of this application as an example, the control device 500 of the vending machine 010 controls the first motor 211*b* to rotate once more and stops rotating after a second preset time, so that the first motor 211*b* conveys the target item once more for the second preset time.

In Step S52, determine whether the target item enters the inside of the bucket within the third preset time from the moment when the first motor stops rotating this time.

Taking the vending machine 010 provided in this embodiment of this application as an example, the control device 500 of the vending machine 010 determines whether the target item enters the inside of the bucket 310 within the third preset time from the moment when the first motor 211*b* stops rotating this time. Based on the determination result that the target item does not enter the inside of the bucket 310 within the third preset time from the moment when the first motor 211*b* stops rotating this time, the control device controls the first motor 211*b* to rotate the next time, i.e., performs Step S51 again. Based on the determination result that the target item enters the inside of the bucket 310 within the third preset time from the moment when the first motor 211*b* stops rotating this time, performs Step S4, i.e., controls the second motor 311*a* to stop rotating. In an embodiment, the third preset time is equal to the first preset time.

Figure 8:
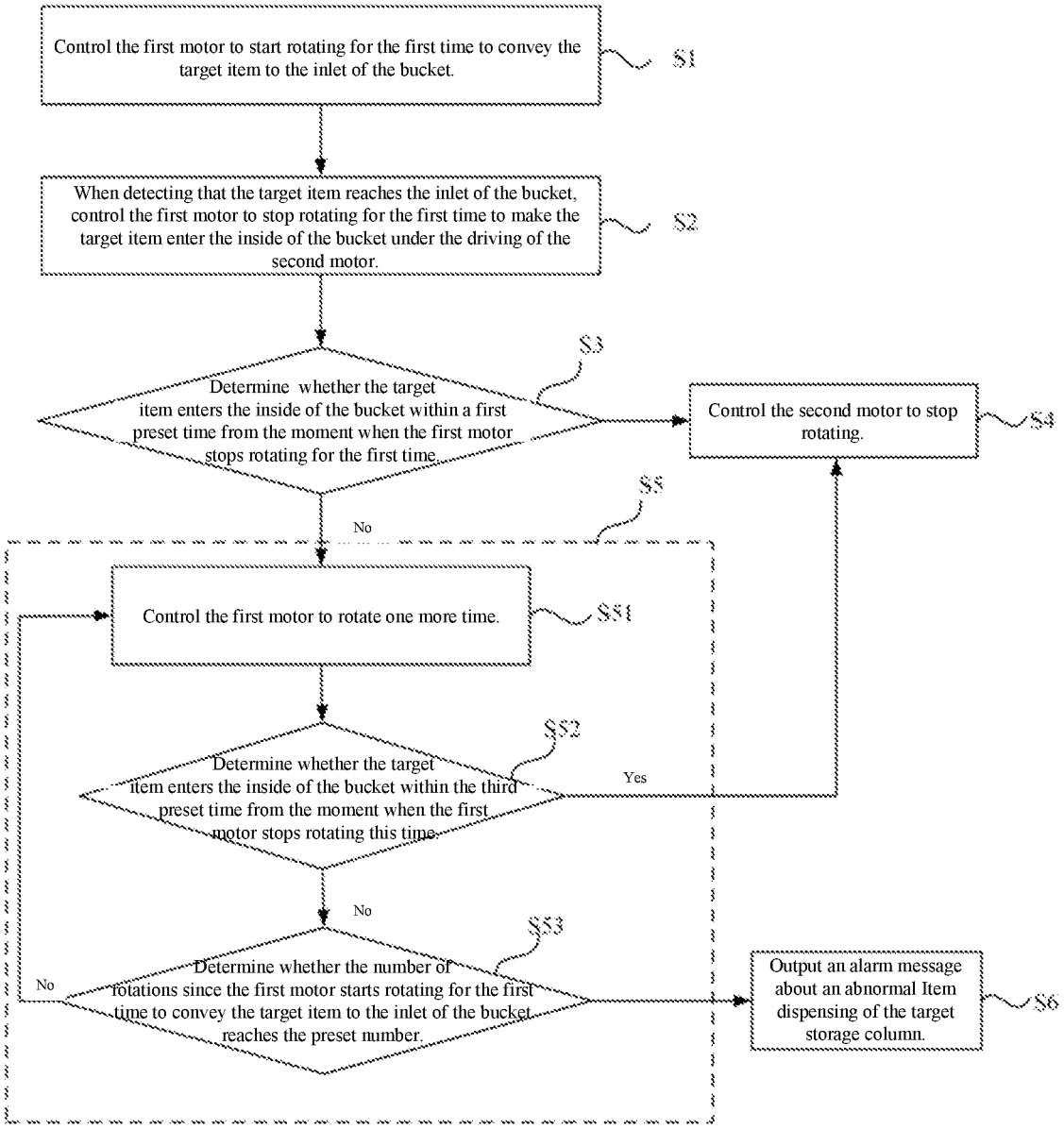
FIG. 8 is a flow chart of a third item dispensing method of a storage column of a vending machine according to an embodiment of this application.

FIG. 8 is a flow chart of a third item dispensing method of a storage column of a vending machine according to an embodiment of this application. This embodiment can be an example of the embodiment shown in FIG. 7. As shown in FIG. 8, this embodiment differs from the embodiment shown in FIG. 7 in that, when determining that the target item does not enter the inside of the bucket 310 within the third preset time from the moment the first motor 211*b* stops rotating this time, the control device determines whether the number of rotations since the first motor 211*b* starts rotating for the first time to convey the target item to the inlet of the bucket 310 reaches the preset number; based on the determination result that the number of rotations of the first motor 211*b* does not reach the preset number, controls the first motor 211*b* to rotate for the next time. Therefore, based on the embodiment of FIG. 7, Step S5 further includes Step S53.

In Step S53, determine whether the number of rotations since the first motor starts rotating for the first time to convey the target item to the inlet of the bucket reaches the preset number.

Taking the vending machine 010 provided in this application as an example, a counting device of the vending machine 010 recording the number of rotations of the first motor 211*b*, the control device 500 determines whether the number of rotations of the first motor 211*b* reaches the preset number based on the number of rotations of the first motor 211*b* recorded by the counting device and the preset number prestored in the vending machine 010. In an embodiment, if the number of rotations of the first motor 211*b* is less than the preset number, the control device determines that the number of rotations of the first motor 211*b* does not reach the preset number. If the number of rotations of the first motor 211*b* is more than or equal to the preset number, the control device determines that the number of rotations of the first motor 211*b* reaches the preset number.

If the number of rotations of the first motor 211*b* does not reach the preset number, the control device performs Step S51.

As shown in FIG. 8, based on the embodiment of FIG. 7, the item dispensing method of this embodiment further includes Step S6, where if the number of rotations of the first motor 211*b* reaches the preset number, the control device performs Step S6.

In Step S6, output an alarm message about an abnormal dispensing of item of the target storage column.

Taking the vending machine 010 provided in this application as an example, the control device 500 outputs the alarm message about the abnormal dispensing of item of the storage column through an alarm device of the vending machine (not shown in the figure).

In the item dispensing method of the storage column of the vending machine provided by this embodiment, when determining that the number of rotations of the first motor reaches the preset number and the target item does not enter the bucket, the control device determines the abnormal dispensing of item of the storage column, and stops controlling the first motor to rotate once more, to avoid the equipment damage risk arising from that first motor continues to rotate repeatedly since the target item never enters the inside of the bucket. The control device outputs the alarm information about the abnormal dispensing of item of the target storage column, and enables maintenance personnel to be notified of abnormal dispensing of item from the target storage column and to recover the normal dispensing of item of the vending machine, and further improve the reliability of the item dispensing of the storage column.

What is claimed is:

1. A vending machine, comprising a control device, a cabinet, a pickup port arranged on the cabinet, a storage column and a bucket arranged inside the cabinet; wherein the storage column is configured to accommodate items; the bucket is arranged between the storage column and the pickup port, and is configured to deliver items between the storage column and the pickup port; the storage column is provided with an outlet, and the bucket is provided with an inlet; the vending machine further comprises a first motor configured to drive the items in the storage column to move toward the outlet of the storage column, a second motor configured to drive the items at the inlet of the bucket to enter the inside of the bucket, and a detecting device configured to detect whether there are items located at the inlet of the bucket; the detecting device, the first motor and the second motor are respectively electrically connected with the control device, and the control device is configured to:

control the first motor to start rotating for the first time to convey the target item to the inlet of the bucket;

control the first motor to stop rotating for the first time to make the target item enter the inside of the bucket under the driving of the second motor when the control device detects that the target item reaches the inlet of the bucket, wherein the target item is at least one item closest to the bucket in the storage column.

2. The vending machine claim 1, wherein the control device is further configured to control the second motor to stop rotating after the target item enters the inside of the bucket.

3. The vending machine of claim 1, the control device is further configured to:

control the bucket to move to the storage column and to make the inlet of the bucket to be opposite to the outlet of the storage column before controlling the first motor to start rotating for the first time to convey the target item to the inlet of the bucket.

4. The vending machine of claim 1, wherein the control device is further configured to:

control the second motor to start rotating when the first motor is controlled to start rotating for the first time so as to make the target item to enter the inside of the bucket under the driving of the second motor.

5. The vending machine of claim 1, wherein the control device is configured to:

determine whether the target item enters the inside of the bucket within a first preset time from the moment when the first motor stops rotating for the first time;

based on the determination result that the target item does not enter the inside of the bucket within the first preset time, control the first motor to rotate at least one more time, where the first motor rotating one time refers to the process that the first motor starts to rotate, and stops rotating after continuously rotating for a second preset time.

6. The vending machine of claim 5, wherein the control device is configured to control the first motor to rotate at least one more time by the following method:

determining whether the target item enters the inside of the bucket within a third preset time from the moment when the first motor stops rotating each time, and based on the determination result that the target item does not enter the inside of the bucket within the third preset time from the moment when the first motor stops rotating this time, controlling the first motor to rotate for the next time.

7. The vending machine of claim 5, wherein the control device is configured to control the first motor to rotate at least one more time by the following method:

determining whether the target item enters the bucket within the third preset time from the moment when the first motor stops rotating each time, based on the determination result that the target item does not enter the inside of the bucket within the third preset time from the moment when the first motor stops rotating this time, determining whether the number of rotations of the first motor since it starts rotating for the first time to convey target item to the inlet of the bucket reaches a preset number, controlling the first motor to rotate for the next time based on the determination result that the number of rotations of the first motor does not reach the preset number.

8. The vending machine of claim 7, wherein the control device is further configured to:

output the alarm information about the abnormal dispensing of item of the storage column when the control device determines that the number of rotations of the first motor reaches the preset number.

9. The vending machine of claim 4, wherein the control device is further configured to control the second motor to stop rotating after the target item enters the inside of the bucket.

10. The vending machine of claim 5, wherein the control device is further configured to control the second motor to stop rotating after the target item enters the inside of the bucket.

11. The vending machine of claim 6, wherein the control device is further configured to control the second motor to stop rotating after the target item enters the inside of the bucket.

12. The vending machine of claim 7, wherein the control device is further configured to control the second motor to stop rotating after the target item enters the inside of the bucket.

13. An item dispensing method of a storage column of a vending machine, wherein the vending machine comprises a cabinet, a pickup port arranged on the cabinet, a storage column and a bucket arranged inside the cabinet; the storage column is configured to accommodate items; the bucket is arranged between the storage column and the pickup port, and is configured to deliver items between the storage column and the pickup port; the storage column is provided with an outlet, and the bucket is provided with an inlet; the vending machine further comprises a first motor configured to drive the items in the storage column to move toward the outlet of the storage column, a second motor configured to drive the items at the inlet of the bucket to enter the inside of the bucket, and a detecting device configured to detect whether there are items located at the inlet of the bucket; the item dispensing method of the storage column comprises:

controlling the first motor to start rotating for the first time to convey the target item to the inlet of the bucket;

when detecting that the target item reaches the inlet of the bucket, controlling the first motor to stop rotating for the first time to make the target item enter the inside of the bucket under the driving of the second motor.

14. The item dispensing method of the storage column of the vending machine of claim 13, further comprising:

determining whether the target item enters the inside of the bucket within a first preset time from the moment when the first motor stops rotating for the first time;

based on the determination result that the target item does not enter the inside of the bucket within the first preset time, controlling the first motor to rotate at least one more time, where the first motor rotating one time refers to the process that the first motor starts to rotate, and stops rotating after continuously rotating for a second preset time.

* * * * *